US007472637B2

(12) United States Patent
Sarva et al.

(10) Patent No.: US 7,472,637 B2
(45) Date of Patent: Jan. 6, 2009

(54) HIERARCHICAL MATERIAL ASSEMBLIES AND ARTICLES FOR USE IN PROJECTILE IMPACT PROTECTION

(75) Inventors: Sai Sarva, Cambridge, MA (US); Adam D. Mulliken, Cambridge, MA (US); Mary C. Boyce, Winchester, MA (US); Alex J. Hsieh, Winchester, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 211 days.

(21) Appl. No.: 11/273,205

(22) Filed: Nov. 14, 2005

(65) Prior Publication Data

US 2006/0249012 A1 Nov. 9, 2006

Related U.S. Application Data

(60) Provisional application No. 60/628,301, filed on Nov. 15, 2004.

(51) Int. Cl.
*F41H 5/04* (2006.01)

(52) U.S. Cl. ..... 89/36.02; 89/36.05; 89/36.08; 2/2.5; 428/911

(58) Field of Classification Search ..... 89/36.02, 89/36.05, 36.08; 2/2.5; 428/911
See application file for complete search history.

(56) References Cited

U.S. PATENT DOCUMENTS 3,324,768 A 6/1967 Eichelberger
3,563,836 A * 2/1971 Dunbar ..... 428/44
3,573,150 A 3/1971 Broutman et al.

(Continued)

FOREIGN PATENT DOCUMENTS

DE 2815582 3/1980

(Continued)

OTHER PUBLICATIONS

S. Wright et al. "Ballistic Impact of Polycarbonate—An Experimental Investigation," 1993, Int. J. Impact Engng, vol. 13, No. 1, p. 1-20.

(Continued)

*Primary Examiner*—Stephen M Johnson
(74) *Attorney, Agent, or Firm*—Gauthier & Connors LLP

(57) ABSTRACT

A hierarchical composite armor is disclosed for protection against projectile impact comprising a plurality of platelets and a matrix substrate. The plurality of platelets are distributed in at least a first layer and in a second layer parallel to the first layer wherein the distribution of the platelets in the second layer is at least slightly offset from and overlaps the distribution of platelets in the first layer. The platelets are less thick than the overall thickness of the composite armor, and the platelets include a first material. The matrix substrate encapsulates the platelets, and the matrix substrate is different than the first material. The platelets and matrix substrate form an interactive network that dissipates a projectile's impact energy over an area much greater than the size of the projectile by synergistically transmitting the impact energy from platelets close to an impact location to platelets away from the impact location. The failure is localized to the primary interaction zone between the projectile and the platelets and matrix substrate. The geometry and distribution of the platelets is tailored to optimize the kinetic energy absorption by the composite armor.

18 Claims, 5 Drawing Sheets

U.S. PATENT DOCUMENTS

| | | | | | |
|---|---|---|---|---|---|
| 3,616,115 | A | * | 10/1971 | Klimmek | 109/84 |
| 3,634,177 | A | * | 1/1972 | Glaser | 428/412 |
| 3,684,631 | A | * | 8/1972 | Dunbar | 428/46 |
| H1061 | H | * | 6/1992 | Rozner et al. | 89/36.02 |
| 5,514,241 | A | * | 5/1996 | Gould et al. | 156/261 |
| H1567 | H | | 8/1996 | Parsons et al. | |
| 6,408,734 | B1 | | 6/2002 | Cohen | |

FOREIGN PATENT DOCUMENTS

| | | |
|---|---|---|
| GB | 2149482 | 6/1985 |
| WO | WO 97/38848 | 10/1997 |

OTHER PUBLICATIONS

D. Nandlall & J. Chrysler, "A Numerical Analysis of the Ballistic Performance of a 6.35-mm Transparent Polycarbonate Plate," Research and Development Branch, Department of National Defence Canada, Dec. 1998.

P. Patel et al., "Transparent Armor," the AMPTIAC Newsletter, Fall 2000, vol. 4, No. 3, p. 1-6.

P. Dehmer & M. Klusewitz, "High Performance Visors," Army Research Laboratory, ARL-RP-45, Aug. 2002.

A. Hsieh et al., "The Effects of PMMA on Ballistic Impact Performance of Hybrid Hard/Ductile All-Plastic- and Glass-Plastic-Based Composites," Army Research Laboratory, ARL-TR-3155, Feb. 2004.

A. Mulliken & M. Boyce, "Understanding the High Rate Behavior of Glassy Amorphous Polymers," 24th Army Science Conference proceedings, 2004.

A. Mulliken, "Low to High Strain Rate Deformation of Amorphous Polymers: Experiments and Modeling," Dept. of Mechanical Engineering, Massachusetts Institute of Technology, Masters Thesis, Jun. 2004.

A. Mulliken & M. Boyce, "Mechanics of the rate-dependent elastic-plastic deformation of glassy polymers from low to high strain rates," International Journal of Solids and Structures 43, available online Jun. 8, 2005, p. 1331-1356.

US 3,684,361, 08/1972, Dunbar (withdrawn)

* cited by examiner

90

92

HIERARCHICAL MATERIAL ASSEMBLIES AND ARTICLES FOR USE IN PROJECTILE IMPACT PROTECTION

PRIORITY

This application claims priority to U.S. Provisional Patent Application Ser. No. 60/628,301 filed Nov. 15, 2004.

This invention was made with government support awarded by the U.S. Army Research Office under Grant No. DAAD-19-02-D-0002. The government has certain rights in the invention.

BACKGROUND

Composite armor materials provide superior protection against impacting projectile threats by using a combination of light-weight and high-strength materials. It is essential that the projectiles are defeated and their energy absorbed or dissipated in a non-lethal manner. For a composite of specific areal density (weight/unit area), resourceful configurations are needed so that the ballistic properties are optimized to the greatest extent. For transparent armor applications it is required that the requisite protection is provided without compromising the visibility. It is also required that protective structures maintain a significant level of their structural integrity after impact so that they provide protection and/or retain significant visibility through successive hits. Armor composites are fabricated using a wide spectrum of materials (metals, ceramics, polymers, organic materials) in various structural forms (monoliths, foams, fabrics, fibers, foils, meshes etc.) A combination of two or more of the above materials can be used depending upon target application and threat. The prior art in composite armor design is well documented with various examples which typically incorporate different materials in laminated structures. Transparent armor systems are comprised of constituent transparent materials such as polymers (poly (methyl methacrylate), polycarbonate, polyurethane, etc.), ceramics (magnesium oxide, spinel, sapphire, aluminum oxynitride etc.) or glass (soda lime, pyrex, tempered glass). Though laminates improve the mechanical properties considerably and are easy to manufacture, they are prone to poor modes of failure such as delamination. Also, cracks are often induced in the more brittle and stiffer components and can propagate extensively across the entire armor plate and ultimately limit structural integrity after a hit.

Some prior art designs explore non planar pellets/components in the armor composite to help defeat/deflect/disorient the projectile. For example, U.S. Pat. No. 3,563,836 discloses using a closed packed distribution of conical discs to help improve the flexibility and increase shear force transfer. There has been a lack of designs, however, that optimize the protection by leveraging the geometrical arrangement of various components and maximizing their synergy depending on the threat conditions.

There is a need, therefore, for more effective and efficient materials and articles for use in projectile impact protection.

SUMMARY OF THE INVENTION

The invention provides a composite armor for protection against projectile impact that includes a plurality of platelets and/or other discrete components (herein referred to as platelets) and a matrix material in accordance with an embodiment. The platelets are distributed in at least a first layer and in a second layer parallel to the first layer. The distribution of the platelets in the second layer is at least slightly offset from and overlaps the distribution of platelets in the first layer. The platelets are less thick than the overall thickness of the composite armor. The platelets comprise a first material and may be formed of monolithic or composite materials. Also, the platelets may be formed of multiple different materials. The continuous or near continuous matrix material encapsulates the platelets in some embodiments. In certain embodiments, the platelets may overlap and may constitute a full layer thickness, and so the matrix may not necessarily be fully continuous. The matrix too may comprise of a monolithic or composite material (e.g., a filled polymer), and may also be formed of different layers of different materials. For example, the matrix in the front layers may be different than the matrix in the back layers. In any given layer the surrounding matrix material is different and has complementary and contrasting mechanical behavior in comparison to the platelet material. The platelets and matrix form an interactive network that dissipates a projectile's impact energy over an area much greater than the size of the projectile by synergistically transmitting the impact force/energy from platelets close to an impact location to platelets away from the impact location. The design also helps localize the failure to a region adjacent and near the impact event, thus preventing catastrophic cracks from propagating thus maintaining the structural integrity during and after impact. The geometry and distribution of the platelets in the matrix is tailored depending on the performance requirement against any specific threats.

BRIEF DESCRIPTION OF THE DRAWINGS

The following description may be further understood with reference to the accompanying drawings in which.

Figure 1:
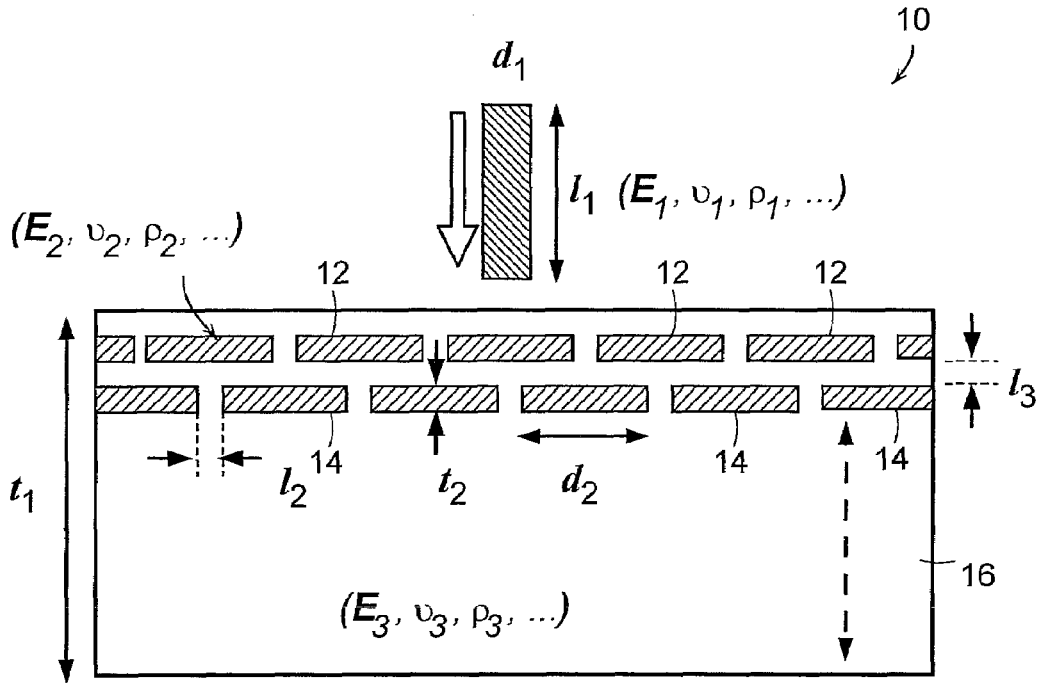
FIG. 1 shows an illustrative diagrammatic view of a hierarchical material in accordance with an embodiment of the present invention.

The drawings are shown for illustrative purposes only and are not to scale.

DETAILED DESCRIPTION OF THE ILLUSTRATED EMBODIMENTS

Polymers are conventionally employed for many impact related applications due to their low densities, low cost, high durability and rate dependent mechanical properties which exhibit a wide range of characteristics including elastic stiffness, yield stress, inelastic deformation by crazing versus and/or yielding, post-yield deformation, and failure mechanisms. These applications range from visors, shields, windows, canopies, and portals of vehicles to non-transparent composite body armor. Recent developments to further manipulate the microstructure of polymers by the incorporation of nanoscale particles further expand the ability to tailor mechanical behavior. Exploitation of the differences in mechanical response of different polymers provides the potential to design multi-scale heterogeneous material assemblies that provide dramatic enhancements in energy absorption of projectile impacts while maintaining the light weight of the homopolymer.

The present invention involves an analysis of the high rate deformation and projectile impact behavior of two amorphous polymers that exhibit significantly contrasting deformation and failure behavior: polycarbonate (PC) and poly (methyl methacrylate) (PMMA). Projectile impact tests were conducted on 6.35 mm thickness plates using a single stage gas-gun. Small (1.4 gm) round-nosed projectiles (5.46 mm diameter) made of 4340 AISI steel were projected into the polymeric plates at velocities ranging from 300 to 550 m/s. High-speed photography was used to visualize the sequence of dynamic deformation and failure events. Numerical simulations of the projectile impact events were conducted using a constitutive model that captures the high rate behavior of polymers together with finite element analysis. These simulations provided information on the stress and deformation fields in the polymer during projectile impact loading conditions. A new hierarchical material assembly has been developed to alter the stress and deformation fields during impact loading conditions and thus enable greater energy absorption. Materials and articles of the invention utilize the contrast in mechanical responses between PC and PMMA, and in particular utilize the differences in their inelastic deformation and failure mechanisms. Such materials and articles further take into account the length-scales of the stress and deformation disturbances resulting from the projectile impact. Assemblies in accordance with various embodiments of the invention have been fabricated, tested, and found to provide strong improvements in the energy absorption of the projectile impact with no weight penalty.

Experiments were performed on 6.35 mm thickness×100 mm width×100 mm length plates of Lexan™ 9034 PC (as sold by GE Polymershapes of Woburn, Mass.) and PlexiGlas G™ PMMA (as sold by GE Polymershapes of Woburn, Mass.). A 12.7 mm bore gas-gun was used to perform projectile impact tests on polymeric samples. The barrel was 2.13 m long and nitrogen was used as the pressurizing gas. A double diaphragm assembly was burst to propel the projectile at the requisite speed. A four piece fly-away injection molded sabot made of glass filled epoxy helped launch the projectile. The sabot and projectile separated in a middle separation chamber and a sabot stopper at the end of this chamber stopped the sabot pieces, allowing the projectile to travel further. The target sample was mounted on a steel frame and clamped on the top and bottom edges. The initial and residual velocities of the projectile were measured with laser ribbon intervalometers. After the perforation of the sample, the projectile was arrested and recovered with the help of paper stacks. A Cordin 32 frame rotating mirror high-speed digital camera, capable of acquiring images at a frame rate of 2 million frames per second, was used to photographically record the dynamic event. The camera and strobe lights were triggered via the initial velocity sensor and a built-in trigger delay was used to synchronize with the event. The projectiles were made of 4340 AISI steel and weighed 1.4 gm ( diameter=5.46 mm; length=8 mm). The projectile design incorporated a rounded nose. The samples were tested at velocities ranging from 300 to 550 m/s. At these velocities, the projectiles perforated the samples and the incident and the residual velocity of the projectile were measured in each experiment, to evaluate the absorbed energy. The residual kinetic energy fraction, $f_{K.E.}$ was calculated by normalizing the residual kinetic energy by the initial kinetic energy of the projectile. If it was determined from the high-speed images that the projectile yaw was more than 10 degrees, the data was discarded.

The failure and deformation modes were examined by means of high-speed photography and post-mortem analysis of recovered samples. Soon after impact, elastic dishing was observed in the target area surrounding the projectile. As the projectile penetrated further the dish extended in size. The projectile perforated the PC sample by shear plugging and no significant plastic deformation was observed in the material immediately adjacent to the plug, further demonstrating the highly localized shear deformation. The recovered projectile showed no visible damage. High-speed photographs of impact on PMMA displayed that the failure was brittle. The zone of impact showed a large number of micro-cracks in the immediate region of the projectile impact. In addition, a few large radial cracks were seen to grow towards the edge of the sample, which compromised the structural integrity. Also, extensive spall was observed from the rear surface. Similar to tests on PC samples, the recovered projectile showed no signs of damage. Additional comparison of the ballistic performance of PC and PMMA homopolymers and PC/PMMA composite laminates is provided by A. J. Hsieh, D. DeSchepper, P. Moy, P. G. Dehmer and J. W. Song, *The Effects of PMMA on Ballistic Impact Performance of Hybrid Hard/Ductile All-Plastic and Glass-Plastic Based Composites*, Army Research Laboratory, Technical Report ARL-TR-3155 (2004). Homopolymers are inadequate at providing superior protection individually but offer the potential to exhibit enhanced ballistic performance when assembled in combination with complementary materials.

A new hierarchical material assembly has been designed to improve the impact resistance and also help inhibit catastrophic failure after impact. A composite material assembly in accordance with an embodiment of the invention involves distribution of discrete lightweight components such as platelets, discs, tablets etc. in a matrix of another lightweight material. For example, FIG. 1 shows an illustrative cross-sectional diagram of a composite material assembly 10 that includes a first layer of discs 12 and a second layer of discs 14 within a matrix material 16. The materials for the discrete components 12, 14 and matrix 16 are chosen such that they exhibit contrasting and complementary mechanical behavior (e.g., hardness, stiffness, yield strength, plasticity, craze conditions, ductility, failure modes and, possibly, different rate-dependence of these properties). The dimensions of the discrete components 12, 14 are smaller in comparison to the matrix 16. In addition to the choice of various materials, a number of geometrical parameters such as the size and distribution may also be specifically designed. An understanding of the effect of each of these parameters on the energy absorption characteristics provide the ability to tailor the design for optimum performance based on the impact conditions. In certain embodiments, the platelets may overlap and may constitute a full layer thickness and so the matrix may not necessarily be fully continuous. Also, the matrix itself may comprise of a composite (e.g., a filled polymer), and may be formed of different layers of different materials. For example, the matrix in the front layers may be different than the matrix in the back layers. Also, the platelets may be formed of multiple different materials. In any given layer the surrounding matrix material is different than the platelet material. The matrix material may differ from layer to layer or may be the same; the platelets may be multiple materials. In various embodiments, the platelet and matrix materials may comprise of monolithic materials, such as a ceramic (e.g., alumina, silicon carbide, boron carbide etc.), a polymer (e.g., polycarbonate, poly(methyl methacrylate)) or a metal (e.g., titanium, aluminum etc.). Alternately, the platelet and matrix materials may also be a composites on a smaller length scale (e.g, polymer-clay nanocomposite, polymer-carbon fiber composite etc.)

The distribution of the platelets in a layer may be random, graded or ordered (e.g., planar array). The distribution of the layers of platelets along the thickness of the matrix material may also be random, ordered or graded. When dispersed along multiple layers, a configuration in which platelets along adjacent layers are slightly offset but still overlapping (as shown in FIG. 1) provides a more efficient method of load/deformation/energy transfer from the projectile to the assembly. For transparent armor applications, all elements of the assembly may be chosen to be transparent. Numerous further parameters may also be explored, and numerical simulations provide an invaluable tool in the understanding and design of these assemblies.

Figure 2:
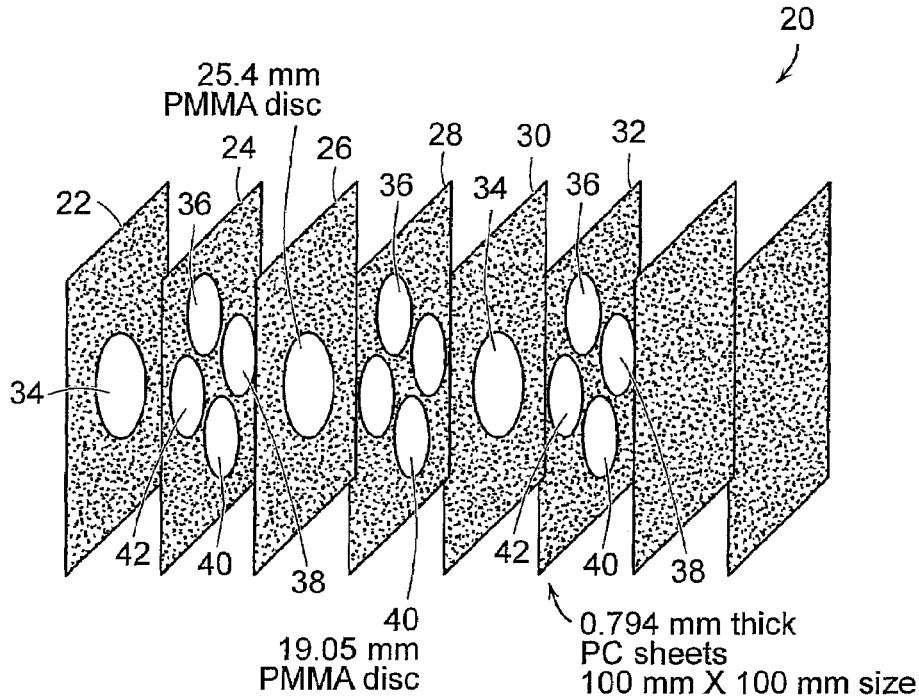
FIG. 2 shows an illustrative diagrammatic view of a design of a hierarchical assembly in accordance with an embodiment of the invention.

FIG. 2 shows an assembly 20 in accordance with another embodiment of the invention that was used for experimental validation. A 6.35 mm thickness plate of PC with distributed platelets of PMMA was considered. The plate had the PMMA platelets distributed over six planes. Alternate layers 22, 24, 26, 28, 30, 32 containing one platelet 34 (2.54 cm diameter, 0.79 mm thickness) and four platelets 36, 38, 40, 42 (each 1.9 cm diameter, 0.79 mm thickness) respectively were arranged in an ABABAB configuration. The layers embedded with one platelet 34 had the platelet located centrally and aligned normal to the line of flight of the projectile. On alternating layers, the four platelets 36, 38, 40, 42 were arranged along a circle around the axis of impact in a symmetric fashion. Each platelet was offset from the center such that it partially overlapped with the single platelet in the layer above/below.

Hierarchical assembly samples were prepared in two simplified designs. Assembly-1: These samples had 6 layers of PMMA discs distributed through a PC sample as discussed above. Assembly-2: The layout of this design was similar to Assembly-1, but only two layers of PMMA discs were distributed. One single PMMA disc (3.81 cm diameter, 1.59 mm thickness) was located centrally and on the next layer, four PMMA discs (2.54 cm diameter, 1.59 mm thickness) were arranged in a circle, offset from the center but overlapping with disc in the plane above. The assemblies were prepared with a hot press by bonding the samples above the glass transition temperature.

Figure 3:
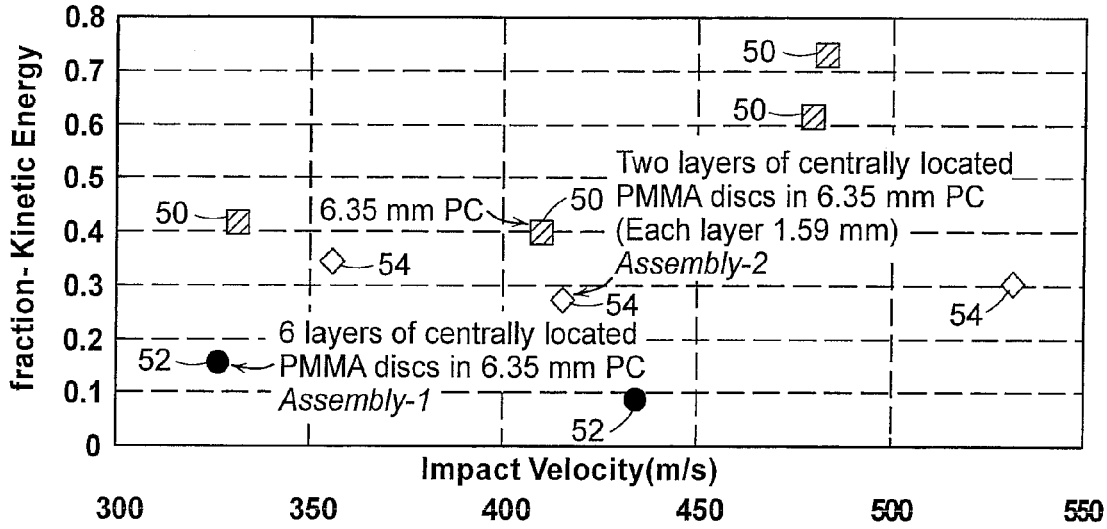
FIG. 3 shows an illustrative graphical representation of experimentally obtained residual kinetic energy versus impact velocity for polycarbonate and for polycarbonate integrated with poly(methyl methacrylate) discs.

Projectile impact tests were conducted on the hierarchical assembly samples at velocities of 300-550 m/s. FIG. 3 shows at 50 that the residual kinetic energy fraction ($f_{KE}$) for monolithic PC plates is 0.41 at an impact velocity of 331 m/s and 0.39 at a velocity of 410 m/s. Under similar impact conditions, the $f_{KE}$ for hierarchical assembly samples with six layers of PMMA discs [Assembly-1] is 0.15 and 0.08 as shown at 52. This indicates that the residual energy upon exiting the armor is reduced by 65-75%. Since the densities of PMMA and PC are similar, this improvement is achieved without the expense of additional mass. Amongst the hierarchical assemblies, six layer PMMA samples [Assembly-1] perform better than the samples with two layers of PMMA discs [Assembly-2] as shown at 54, which can be attributed to a larger amount of PMMA interacting with the projectile.

In complementary work, a combined experimental and analytical investigation was carried out in order to better understand the high-rate behavior of glassy amorphous polymers and develop a new three-dimensional large strain rate-dependent elastic-viscoplastic constitutive model as discussed by Mulliken, A. D and Boyce, M. C, *Mechanics of rate-dependent elastic-plastic deformation of glassy polymers from low to high strain rates,* International Journal of Solids and Structures, 2005- in press, the disclosure of which is hereby incorporated by reference. This constitutive model was numerically implemented into a commercial finite element code, ABAQUS/Explicit and experimentally validated. Numerical simulations were conducted to study the stress and deformation conditions in polymeric samples under impact.

Figures 4A, 4B:
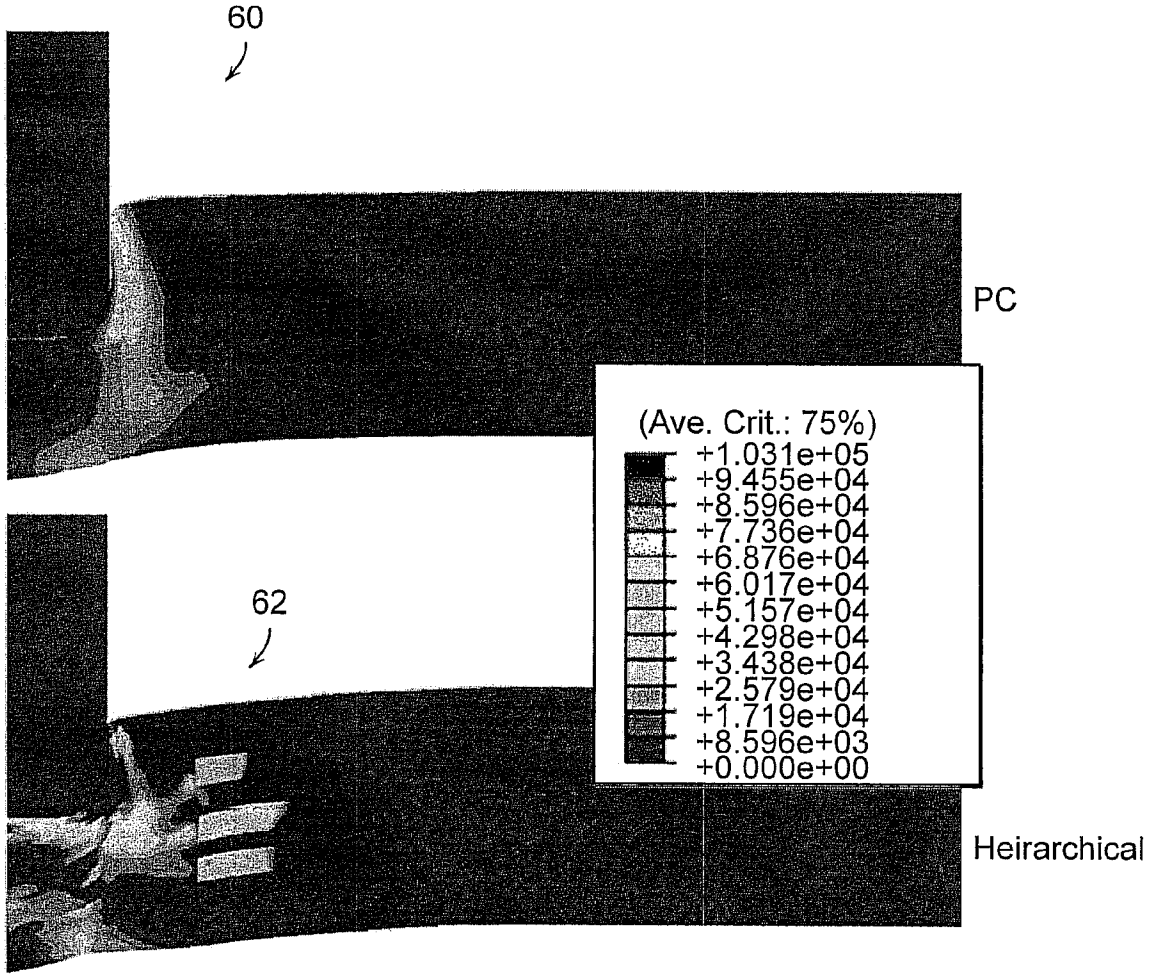
FIGS. 4A and 4B show illustrative diagrammatic views of plastic strain rate for polycarbonate and for a material in accordance with an embodiment of the invention respectively.
Figures 5A, 5B:
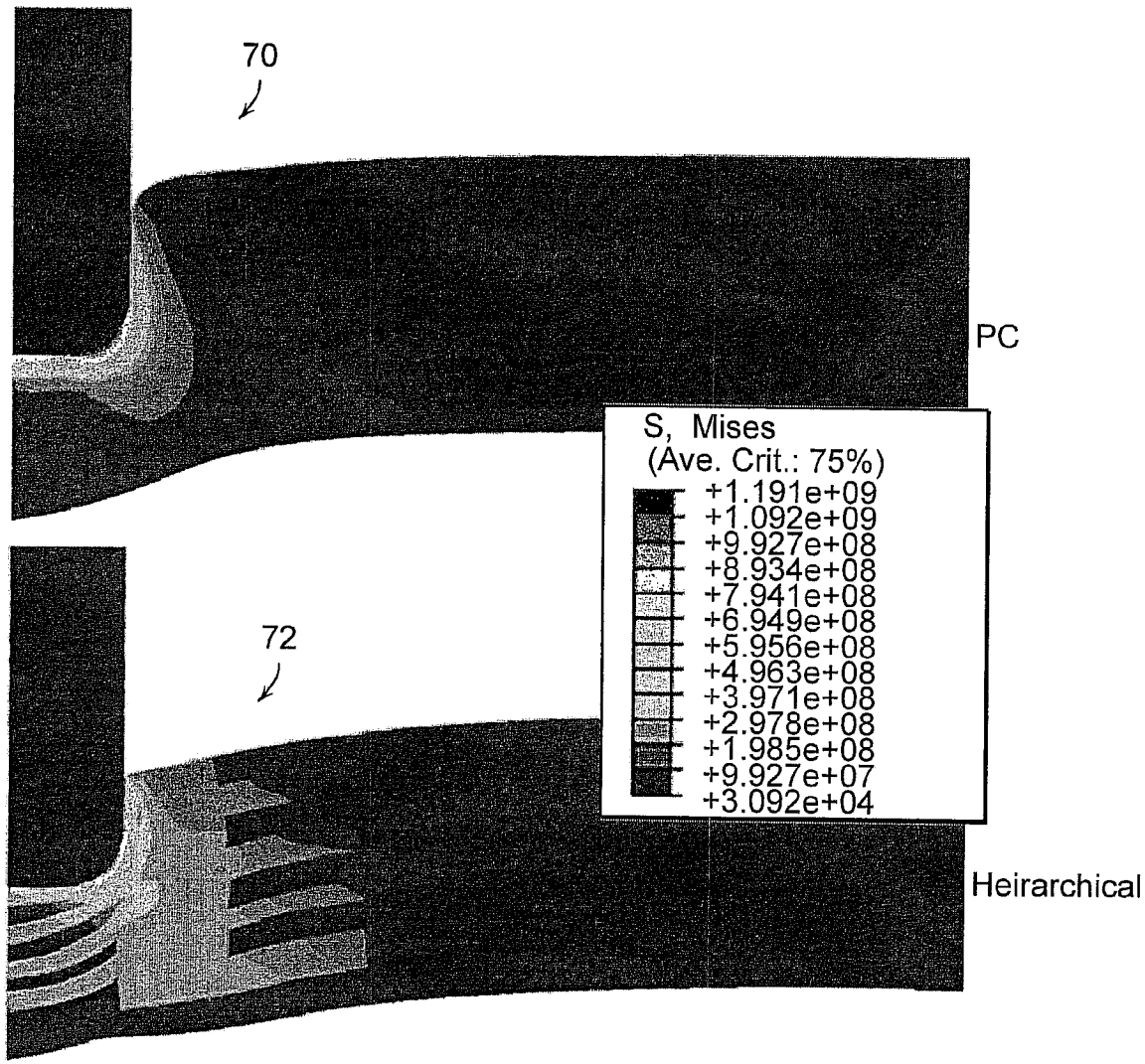
FIGS. 5A and 5B show illustrative diagrammatic views of the induced Mises stress upon an impact for polycarbonate and for a material in accordance with an embodiment of the invention respectively.

Simulations were performed to study the impact of a round-nosed projectile on a 6.35 mm thickness PC and hierarchical assembly plates. The projectile design was the same as discussed in detail above. The impact velocity was chosen to be 300 m/s. The projectile and plates were modeled as 2-D axisymmetric and 4-node quadrilateral reduced-integration elements were used. The results are used for a qualitative understanding. FIG. 4A shows the contours of plastic strain rate for PC (as shown at 60). Elastic-viscoplastic deformation is evident in the region beneath the projectile. In particular, a concentrated circumferential region of localization that is ultimately responsible for shear plugging failure was observed. FIG. 4B shows the contours of plastic strain rate for a hierarchical assembly (as shown at 62) for comparison. For simulations, the model parameters for PMMA were separate from those for PC and were derived from experimental studies on PMMA. It is observed that the overlapping discs increase the interaction zone between the projectile and the target by forming a network of interacting components. FIGS. 5A and 5B show the comparison of Mises stress contours induced in a monolithic PC plate (as shown at 70) with those induced in a hierarchical assembly sample (as shown at 72). The magnified interaction zone is again evident.

Figure 6:
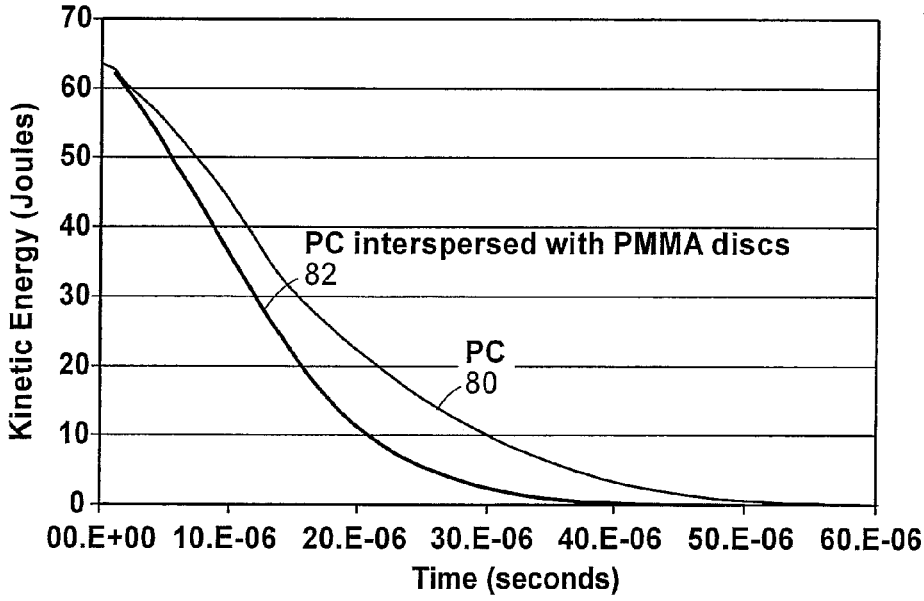
FIG. 6 shows an illustrative graphical representation of the kinetic energy of projectiles over time during impact for polycarbonate and for polycarbonate integrated with poly (methyl methacrylate) discs.

To compare the penetration resistance, the kinetic energies of the projectiles are compared in FIG. 6 wherein the kinetic energy for the projectile in monolithic PC is shown at 80 while the kinetic energy for projectile in PC interspersed with PMMA discs is shown at 82. The kinetic energy is consumed at a higher rate for the hierarchical assembly sample, indicating an increased energy absorption and faster arrest. Numerical simulations also predict that the depth of penetration (failure was not incorporated in the simulations) for the hierarchical sample is nearly 40% less than the monolithic sample. Again, this is a qualitative comparison.

Figure 7:
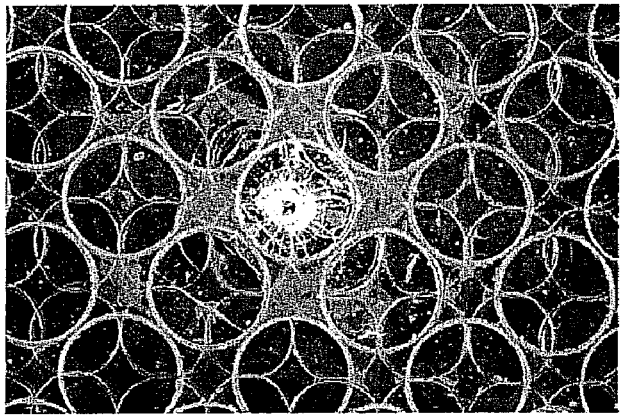
FIG. 7 shows an illustrative diagrammatic view of a sample with uniformly distributed poly(methyl methacrylate) discs following impact.
Figure 8:
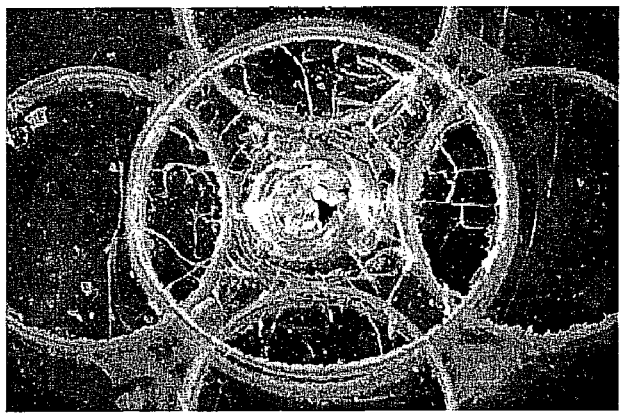
FIG. 8 shows an illustrative diagrammatic view of a sample with 6 layers of poly(methyl methacrylate) discs following impact.

Furthermore, the damaged zone is contained. FIG. 7 shows at 90 the impact zones of a recovered hierarchical assembly sample with uniformly distributed PMMA discs, and FIG. 8 shows at 92 the impact zones of a recovered hierarchical assembly sample with 6 layers of PMMA discs. As can be seen, the brittle failure of PMMA discs is confined locally. The cracks are arrested at the matrix-platelet interface. It is also observed that the platelets that are not directly in the line of impact show failure/damage, indicating that the effect of overlap is successful. A large back plate plug was observed in the recovered hierarchical assembly samples, indicating that, unlike PC, in which no residual damage was observed outside of the perforation area, the interaction zone between projectile and assembly sample was much larger. Hence, for a hierarchical sample, a greater amount of kinetic energy is absorbed and the impact is spread over a wider area.

To summarize, impact-perforation tests were performed on PC and PMMA plates at velocities ranging from 300 to 550 m/s. The failure and energy absorption mechanisms have been studied using high speed photography and numerical simulations. A new hierarchical material assembly has been implemented. The hierarchical assembly distributes discrete components in a continuous matrix. The components and matrix are chosen to have contrasting mechanical deformation and failure mechanisms and properties. The impact failure zone is magnified due to an interacting network created by the arrangement of these discrete components. This leads to an activation of multitude of energy absorption regions. The matrix acts to accommodate the failure and deformation of the components and contain the structural failure to the impact zone. This helps maintain the structural integrity during and after impact. The hierarchical assembly may be extended to include more than two materials with different properties. It can also be extended to include material constituents, which are not monolithic but composites themselves at a smaller length scale.

Those skilled in the art will appreciate that numerous modifications and variations may be made to the above disclosed embodiments without departing from the spirit and scope of the invention.

The invention claimed is:

1. A hierarchical composite armor for protection against projectile impact comprising a plurality of plates used to define a plurality of platelets distributed in at least a first layer and in a second layer parallel to the first layer wherein the distribution of the platelets in the second layer is at least slightly offset from and overlaps the distribution of platelets in the first layer, said plates comprising two amorphous polymers that exhibit significantly contrasting deformation and failure behavior, wherein the platelets are less thick than the overall thickness of the composite armor and wherein the platelets and a matrix substrate comprise of different materials; and said matrix substrate encapsulating the platelets;

wherein the first material and the matrix substrate have different mechanical properties;

wherein the platelets and matrix substrate form an interactive network that dissipates a projectile's impact energy over an area much greater than the size of the projectile by transmitting the impact energy from platelets close to an impact location to platelets away from the impact location by arranging in an alternating fashion said plates having two amorphous polymers where the platelets of one of the first set of alternating plates are positioned centrally and the platelets of the second set of alternating plates are positioned along one or more circles, each of said platelets are offset from a center such that they partially overlap with another of said platelets; and wherein the geometry and distribution of the platelets is tailored to optimize the kinetic energy absorption by the composite armor.

2. The composite as claimed in claim 1, wherein said matrix material includes a plurality of layers.

3. The composite as claimed in claim 1, wherein said matrix material is formed of a plurality of materials.

4. The composite as claimed in claim 1, wherein said platelets are formed of a plurality of materials.

5. The composite as claimed in claim 1, wherein said plurality of platelets is distributed in at least a third layer.

6. The composite as claimed in claim 1, wherein said plurality of platelets distributed in various layers are arranged in an ordered fashion.

7. The composite as claimed in claim 1, wherein said layers containing the platelets are arranged at ordered intervals along the thickness of the matrix substrate.

8. The composite as claimed in claim 1, wherein said layers containing the platelets are arranged in a graded fashion along the thickness of the matrix material so as to maintain said offset.

9. The composite as claimed in claim 1, wherein said composite further includes a backing that is joined to a rear surface of the matrix substrate.

10. The composite as claimed in claim 9, wherein said backing material comprises a second material.

11. The composite as claimed in claim 1, wherein said first layer includes a composite material.

12. The composite as claimed in claim 1, wherein said first layer includes at least one of ceramic, metal and a polymer.

13. The composite as claimed in claim 1, wherein said matrix substrate includes a composite material.

14. The composite as claimed in claim 1, wherein said matrix substrate includes at least one of ceramic, metal and a polymer.

15. The composite as claimed in claim 1, wherein said first layer and said matrix substrate are optically transparent.

16. The composite as claimed in claim 1, wherein said plurality of platelets comprises a symmetrical profile.

17. The composite as claimed in claim 1, wherein said plurality of platelets comprises an asymmetric profile.

18. A hierarchical composite armor for protection against projectile impact comprising a matrix substrate surrounding a plurality of plates used to define a plurality of platelets distributed in at least a first layer and in a second layer parallel to the first layer within the matrix, said plates comprising two amorphous polymers that exhibit significantly contrasting deformation and failure behavior, wherein the distribution of the platelets in the second layer is at least slightly offset from and overlaps the distribution of platelets in the first layer, wherein the platelets are less thick than the overall thickness of the composite armor, and wherein the platelets include a first material has different mechanical properties than mechanical properties of the matrix substrate; and wherein kinetic energy absorption is increased through synergistic interactions between the plurality of platelets and the matrix by arranging in an alternating fashion said platelets having two amorphous polymers where the platelets of one of the first set of alternating plates are positioned centrally and the platelets of the second set of alternating plates are positioned along one or more circles, each of said platelets are offset from a center such that they partially overlap with another of said platelets.

* * * * *